United States Patent [19]

Cantrell et al.

[11] Patent Number: 4,540,005

[45] Date of Patent: Sep. 10, 1985

[54] CIGARETTE HAVING A MOUTHPIECE

[75] Inventors: Daniel V. Cantrell, Prospect; Dale A. Halverstadt, Louisville, both of Ky.

[73] Assignee: Brown & Williamson Tobacco Corporation, Louisville, Ky.

[21] Appl. No.: 558,222

[22] Filed: Dec. 5, 1983

[51] Int. Cl.[3] ..... A24D 3/04

[52] U.S. Cl. ..... 131/336; 131/339; 131/340

[58] Field of Search ..... 131/336, 339, 340

[56] References Cited

FOREIGN PATENT DOCUMENTS 2849904 5/1979 Fed. Rep. of Germany ..... 131/336

*Primary Examiner*—V. Millin

*Attorney, Agent, or Firm*—Charles G. Lamb

[57] ABSTRACT

A smoking article, such as a cigarette, has a mouth section which includes a generally cylindrical, impermeable, plug member located in coaxial abutment to one end of the tobacco column of the cigarette. A plurality of smoke flow capillaries are formed through the plug member. A generally hollow cylindrical tubular mouthpiece having a plurality of grooves are formed in the periphery of the mouth section extending generally longitudinally thereof is located in coaxial abutment to the end of the plug member. Air permeable tipping material circumferentially surrounds the mouth section and overlaps a portion of the tobacco column adjacent the mouth section to fasten the mouth section to the tobacco column. In a further embodiment of the present invention, the mouth section includes the generally cylindrical impermeable plug located in coaxial abutment to one end of the tobacco column formed with a plurality of generally longitudinally extending grooves in the peripheral surface in addition to having smoke flow capillaries therethrough. A generally cylindrical, tubular mouthpiece is located in coaxial abutment to the end of the plug member. Air permeable tipping material circumscribes the mouth section and overlaps a portion of the tobacco column adjacent the mouth section to fasten the mouth section to the tobacco column.

24 Claims, 7 Drawing Figures

CIGARETTE HAVING A MOUTHPIECE

BACKGROUND OF THE INVENTION

1. Field of the Invention

The present invention relates to smoke diluting devices, and more particularly to a mouth section for a cigarette, or the like, which reduces tar exclusively by ventilation.

2 Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves in the smoker's mouth whereat the smoke is diluted. Examples of cigarette filters having grooves for the introduction of ventilating air into the filtering ends are shown in the following Patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways, and transverse passageways interconnecting the longitudinal passageways and central passageway with each other and with the ambient air. As the cigarette to which the device is smoked, smoke and ambient air traverses the longitudinal and central passageways wherein the smoke and air mixed before delivery to the smoker's mouth.

Devices are also known for delivering unfiltered smoke and ventilation air to the smoker's mouth. For example, U.S. Pat. No. 4,023,576 teaches a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straightforward arrangement for a mouth section of a cigarette for lowering tar exclusively by ventilation.

More particularly, in one advantageous embodiment, the present invention provides a cigarette comprising a generally cylindrical tobacco column, a generally cylindrically shaped impermeable plug member located in coaxial abutment with one end of the tobacco column, a plurality of smoke flow capillaries formed through the plug member generally longitudinally of the plug member such that each capillary has an open inlet at the end of the plug member in abutment with the tobacco column and an open outlet at the other end of the plug member, a generally cylindrical, tubular mouthpiece located in coaxial abutment with the end of the plug member opposite that end in abutment with the tobacco column, a plurality of ventilating air flow grooves formed in the peripheral surface of the mouthpiece extending generally longitudinally of the mouthpiece from one end of the other end, the grooves being generally equally circumambiently spaced about the mouthpiece, and tipping material circumscribing the mouthpiece and plug member, and overlapping a portion of the tobacco column adjacent the plug member, the tipping material being air permeable over at least a portion of each of the grooves.

In another advantageous embodiment, the present invention provides a cigarette comprising a generally cylindrical tobacco column, a generally cylindrically shaped impermeable plug member located in coaxial abutting relationship with one end of the tobacco column, a plurality of smoke flow capillaries formed through the plug member generally longitudinally of the plug member such that each capillary has an open inlet at the end of the plug member in abutment with the tobacco column and an open outlet at the other end of the plug member, a plurality of ventilating air flow grooves formed in the peripheral surface of the plug member extending generally longitudinally of the plug member from one end of the plug member, each of the grooves being open to at least the end of the plug member having the open outlets from the capillaries, a generally cylindrical tubular mouthpiece located in coaxial abutting relationship to the end of the plug member having the open capillary outlets, and permeable tipping material circumscribing the plug member and mouthpiece and overlapping a portion of the tobacco column adjacent the plug member, the tipping material being air permeable over at least a portion of each of the ventilation air grooves.

BRIEF DESCRIPTION OF THE DRAWINGS

The various features and advantages of the present invention will become even more clear upon reference to the following description and accompanying drawings wherein like numerals refer to like parts throughout, and in which.

DESCRIPTION OF THE PREFERRED EMBODIMENT

Figure 1:
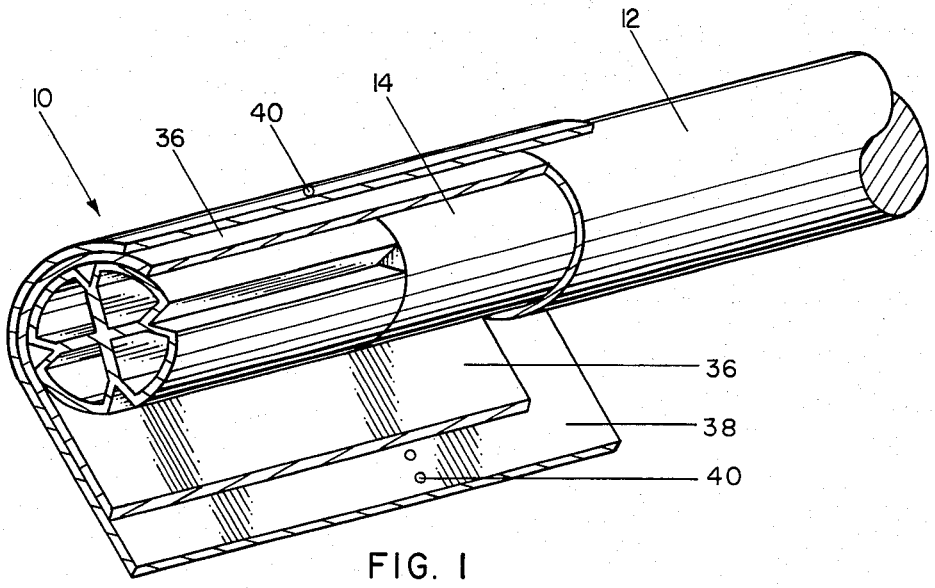
FIG. 1 is a perspective view of a cigarette including one advantageous embodiment of the present invention, the tipping material being illustrated as partially unwound to more clearly show details.

FIG. 1 illustrated a mouth section of the present invention, generally denoted as the number 10, attached to a generally cylindrical tobacco column 12.

Figure 2:
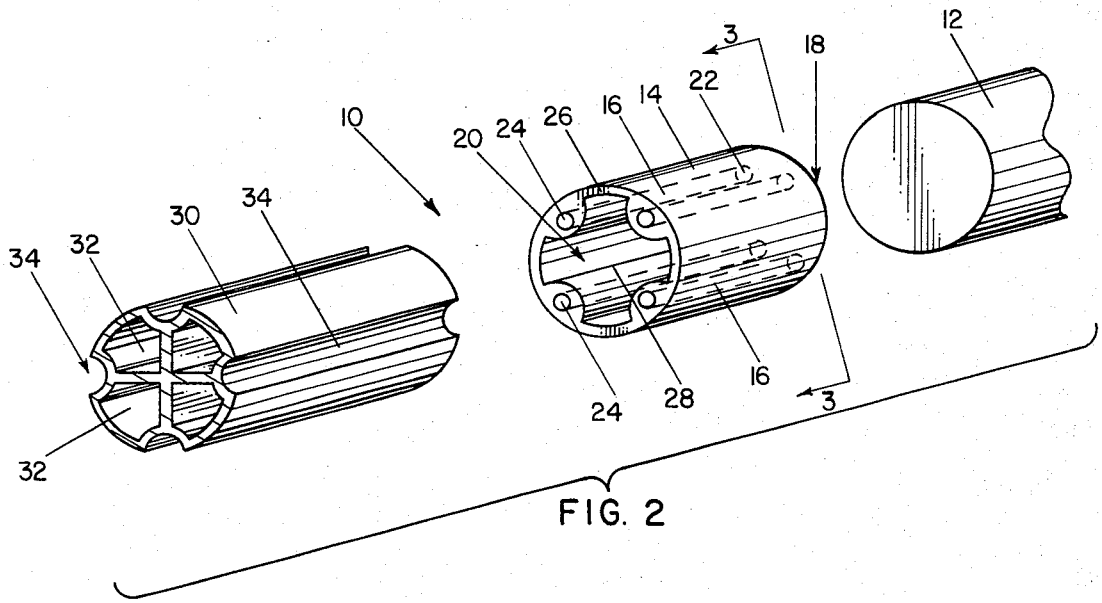
FIG. 2 is an exploded perspective view of the cigarette of FIG. 1.
Figure 3:
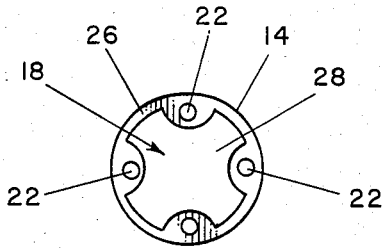
FIG. 3 is an end view of a component of the invention as seen in the direction of arrows 3—3 in FIG. 2.

With continued reference to FIG. 1 and additional reference to FIGS. 2-3, the mouth section 10 is shown as including a substantially cylindrically shaped impermeable plug member 14 having substantially the same diameter as the tobacco column 12 coaxially located at one end of the tobacco column 12 and in abutment therewith. The plug member 14 is fabricated of an essentially smoke and air impermeable material. The impermeable plug member 14 is formed with a plurality of smoke flow-through capillaries 16 extending generally longitudinally through the plug member 14 from one end 18 to the other end 20 thereof. Each capillary 16 has an open inlet 22 at the plug end 18 in abutment with the tobacco column 12 and an open outlet 24 at the other plug end 20. The open capillary inlets 22 are spaced circumambiently of the plug end 18, and are preferably, equally spaced apart. Further, the open capillary inlets 22 are closely adjacent to the peripheral surface of the plug member 14. Similarly, the open capillary outlets 24 are spaced circumambiently of the plug end 20, and are preferably, equally spaced apart. In addition, the open capillary outlets 24 are closely adjacent to the peripheral surface of the plug member 14. As mentioned, the plug member 14 is impermeable to smoke and air. Toward this end, the peripheral wall 26 of the plug member 14 is fabricated of an extruded plastic such as, for example, a polyethylene while the core 28 of the plug member 14 is fabricated of another air impermeable material such as, for example, a closed cell cellulose acetate, a blocked open cell cellulose acetate or blocked fiberous cellulose acetate. The otherwise porous open cell cellulose acetate and fibrous cellulose acetate can be blocked to make it essentially impermeable by various suitable additives such as, for example, polyethylene glycol. Still further, the walls of the capillaries 16 are defined in the polyethylene material forming the peripheral wall 26 of the plug member 14. Advantageously, the plug member 14 can be made by the concurrent extrusion of the peripheral plug wall 26 and core 28.

The mouth section 10 further includes a generally cylindrical tubular mouthpiece 30 having substantially the same diameter as the plug member 14 coaxially located with the plug member 14 and in abutment with the end 20 of the plug member 14. The peripheral wall 32 of the mouthpiece 30 is air and smoke impermeable. A plurality of grooves 34 are formed in the peripheral surface of the peripheral wall 32 of the mouthpiece 30. The grooves 34 extend generally longitudinally of the mouthpiece 30 from one end to the other end thereof and are shown as being equally spaced apart about the circumference of the mouthpiece 30. As can be best seen in FIG. 2, the open capillary outlets 24 are in smoke flow communication with the hollow interior at the end of the mouthpiece 30 which is in abutment with the end 20 of the plug member 14. Therefore, as illustrated, the open capillary outlets 24 are spaced inwardly from the peripheral surface of the plug member 14 by a distance somewhat greater than the thickness of the peripheral wall 32.

As shown, the number of grooves 34 is equal to the number of smoke flow capillaries 16. A layer of air permeable wrap 36 circumscribes the plug member 14 and mouthpiece 30 holding them together. The mouth section 10 is shown as being attached to the tobacco column 12 by an air permeable tipping material 38 which circumscribes the mouth section 10 and overlaps a portion of the tobacco column 12 adjacent the end 18 of the plug member 14. At least a portion of the tipping material 38 surrounding the mouthpiece 30 is air permeable over at least a portion of the grooves 34 in the mouthpiece 30. The tipping material 38 can be fabricated of a porous material or, as shown, the air permeability can be provided by forming small perforations 40 through the thickness of the otherwise air impermeable tipping material 38.

Figure 4:
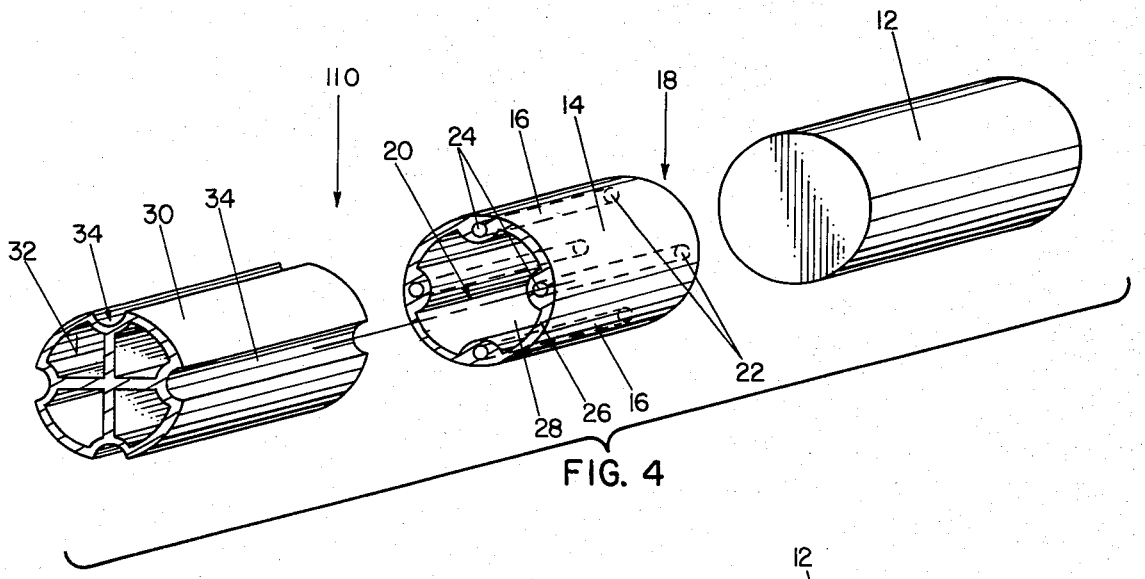
FIG. 4 is an exploded perspective view of the cigarette of FIG. 1 with one component repositioned from that shown in FIG. 2.

FIG. 4 illustrates a mouth section 110 which is virtually identical to the mouth section 10 of FIG. 1-2 except that instead of the open capillary outlets 24 being in flow communication with the hollow interior of the mouthpiece 30, the open capillary outlets 24 of each capillary 16 are in flow communication with a different one of the grooves 34 of the mouthpiece 30. This is accomplished by orienting the mouthpiece 30 relative to the plug member 14 so that the open capillary outlets 24 are in registration with the grooves 34.

Figure 5:
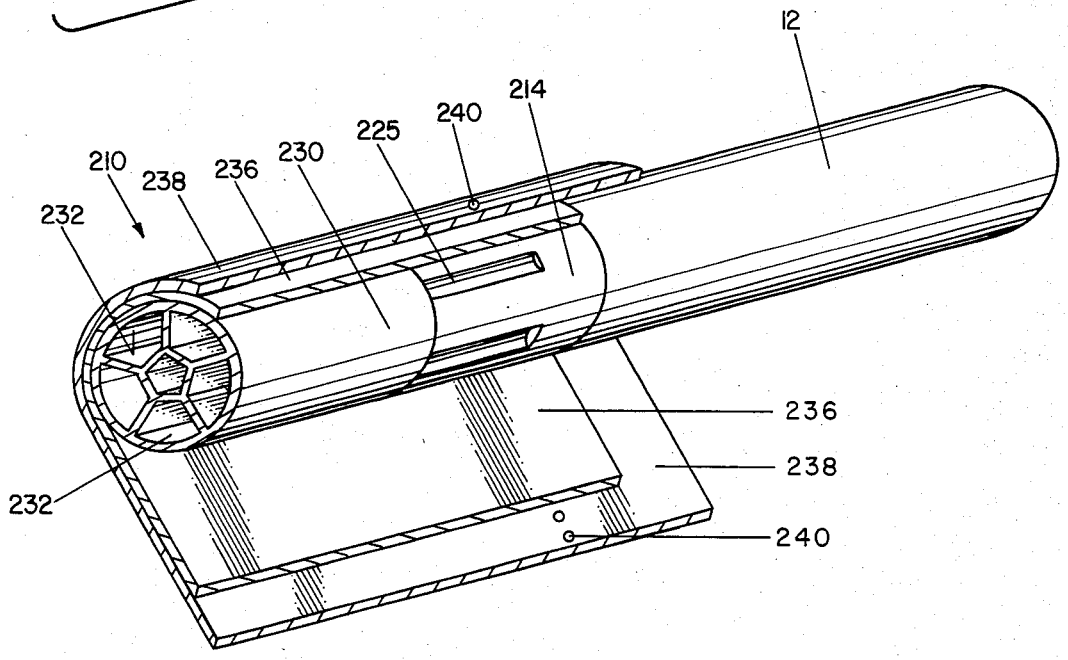
FIG. 5 is a perspective view of a cigarette including another advantageous embodiment of the present invention.
Figure 6:
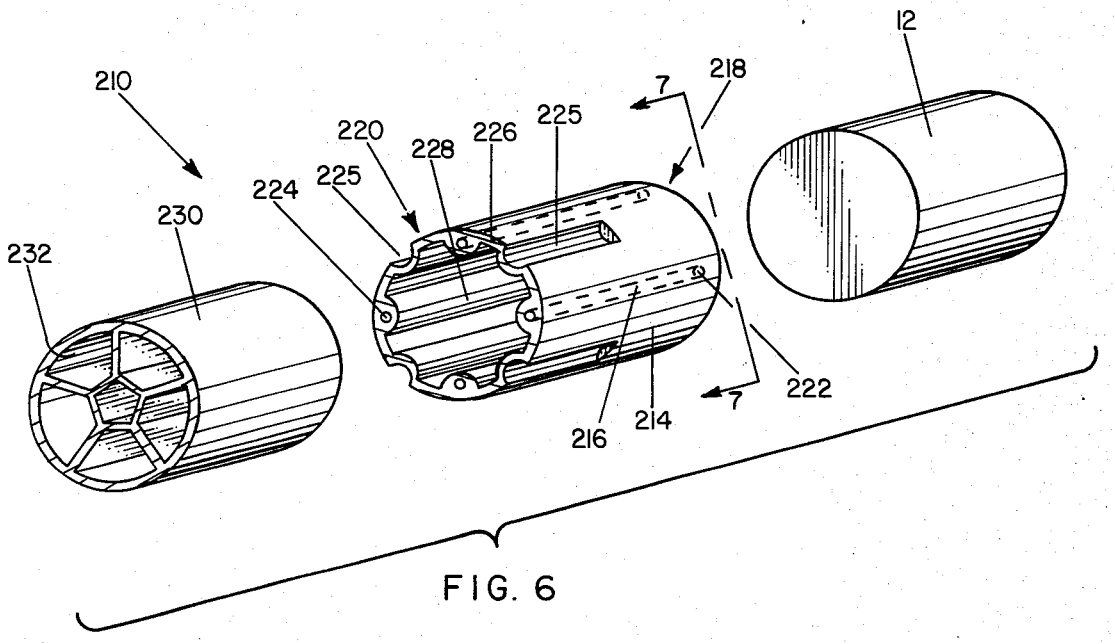
FIG. 6 is an exploded perspective view of the cigarette of FIG. 5.
Figure 7:
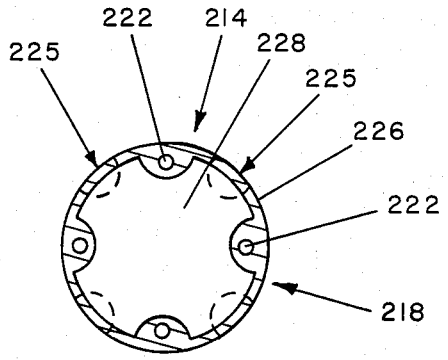
FIG. 7 is an end view of a compoinent of the invention as seen in the direction of arrows 7—7 in FIG. 6.

Turning now to FIGS. 5 through 7, there is shown a mouth section 210 attached to a tobacco column 12.

The mouth section 210 is shown as including a substantially cylindrically shaped impermeable plug member 214 having substantially the same diameter as the tobacco column 12 coaxially located at one end of the tobacco column and in abutment therewith. The plug member 214 is fabricated of an essentially smoke and air impermeable material. The impermeable plug member 214 is formed with a plurality of smoke flow-through capillaries 216 extending generally longitudinally through the plug member 214 from one end 218 to the other end 220 thereof. Each capillary 216 has an open inlet 222 at the plug end 218 in abutment with the tobacco column 12 and an open outlet 224 at the other plug end 220. The open capillary inlets 222 are spaced apart circumambiently of the plug end 218, and are preferably equally spaced apart. Further, the open capillary inlets 222 are closely adjacent to the peripheral surface of the plug member 214. Similarly, the open capillary outlets 224 are spaced apart in a circular array circumferentially of the plug end 220, and are preferably equally spaced apart. In addition, the open capillary outlets 224 are closely adjacent to the peripheral surface of the plug member 214. In addition, a plurality of grooves 225 are formed in the peripheral surface of the plug member 214. Each groove 225 is open to and extends generally longitudinally of the plug member 214 from one end 220 a predetermined distance less than the length of the plug member 214. As shown, the grooves 225 are circumambiently spaced equally about the plug member 214. As previously mentioned, the plug member 214 is impermeable to smoke and air. As shown, the peripheral wall 226 of the plug member 214 is fabricated of an extruded plastic such as, for example, a polyethylene, while the core 228 of the plug member 214 is fabricated of another air and smoke impermeable material such as, for example, a closed cell cellulose acetate, a blocked open cell cellulose acetate, or blocked fibrous cellulose acetate. The otherwise porous open cell cellulose acetate and fibrous cellulose acetate can be blocked to make it essentially impermeable by various suitable additives such as, for example, polyethylene glycol. The walls of the capillaries 216 form the peripheral wall 226 of the plug member 214.

The mouth section 210 further includes a generally cylindrical tubular mouthpiece 230 having substantially the same diameter as the plug member 214 coaxially located with the plug member 214 and in abutment with the end 220 of the plug member 214 having the open capillary outlets 224. The peripheral wall 232 of the mouthpiece 230 is air and smoke impermeable. The open capillary outlets 224 and the grooves 225 at the plug end 220 are in flow communication with the hollow interior of the mouthpiece 230. Therefore, as illustrated, the grooves 225 are deeper than the thickness of the peripheral wall 232 of the mouthpiece 230 and the open capillary outlets 224 are spaced inwardly from the peripheral surface of the plug member 214 by a distance somewhat greater than the thickness of the peripheral wall 232 of the mouthpiece 230. As shown, the number of grooves 225 is equal to the number of smoke capillaries 216.

A layer of air permeable wrap 236 circumscribes the plug member 214 and mouthpiece 230 holding them together. The mouth section 210 is shown as being attached to the tobacco column 12 by an air permeable tipping material 238 which circumscribes the mouth section 110 and overlaps a portion of the tobacco column 12 adjacent the end 218 of the plug member 214. At least a portion of the tipping material 238 surrounding the plug member 214 is air permeable over at least a portion of the grooves 225 in the plug member 214. The tipping material 238 can be fabricated of a porous material or, as shown, the air permeability can be provided by forming small perforations 240 through the thickness of the otherwise air permeable tipping material 238.

The foregoing detailed description is given primarily for clearness of understanding and no unnecessary limitation should be understood therefrom for modifications will become obvious to those skilled in the art upon reading this disclosure and may be made without departing from the spirit of the invention and scope of the appended claims.

What is claimed is:

1. A cigarette comprising:

a generally cylindrical tobacco column;

a generally cylindrically shaped impermeable plug member located in coaxial abutment with one end of the tobacco column;

a plurality of smoke flow through capillaries formed through the plug member generally longitudinally of the plug member such that each capillary has an open inlet at the end of the plug member in abutment with the tobacco column and an open outlet at the opposite end of the plug member;

a generally cylindrical, tubular mouthpiece located in coaxial abutment with the end of the plug member opposite that end in abutment with the tobacco column, so that smoke from the tobacco column flows through the smoke flow capillaries in the plug member into the hollow interior of the tubular mouthpiece and then into the smoker's mouth;

a plurality of grooves formed in the peripheral surface of the mouthpiece extending generally longitudinally of the mouthpiece from one end to the other end, the grooves being generally equally spaced apart about the circumference of the mouthpiece; and, air permeable tipping material circumscribing the mouthpiece and plug member, and overlapping a portion of the tobacco column adjacent the plug member, thereby providing for the flow of only ventilating air through the tipping material into the grooves of the mouthpiece so that only ventilation air flows in the grooves to the smoker's mouth.

2. The cigarette of claim 1, wherein the wall of the mouthpiece is impermeable.

3. The cigarette of claim 1, wherein: the open inlets of the capillaries are circumambiently arranged; and, the open outlets of the capillaries are circumambiently arranged.

4. The cigarettes of claim 1 wherein the open outlets of the capillaries are spaced inwardly of the peripheral surface of the plug member by a distance at least as great as the thickness of the wall of the mouthpiece.

5. The cigarette of claim 1, wherein the open outlets of the capillaries are adjacent the interior surface of the wall of the mouthpiece.

6. The cigarette of claim 1, wherein the tipping material is air permeable over at least a portion of each of the grooves in the mouthpiece.

7. The cigarette of claim 1, wherein the number of grooves in the mouthpiece is equal to the number of capillaries in the plug member.

8. The cigarette of claim 1, further comprising a porous wrap material circumferentially surrounding the plug member and the mouthpiece beneath the tipping material.

9. The cigarettes of claim 1, wherein the plug member further comprises:

a polyethylene plastic peripheral wall; and, an impermeable cellulose acetate core.

10. The cigarette of claim 9, wherein the capillaries are formed in the polyethylene wall of the plug member.

11. The cigarette of claim 9, wherein the polyethylene plug wall and cellulose acetate plug core are formed by coextrusion.

12. A cigarette comprising:

a generally cylindrical tobacco column;

a generally cylindrically shaped impermeable plug member located in coaxial abutment with one end of the tobacco column;

a plurality of smoke flow through capillaries formed through the plug member generally longitudinally of the plug member such that each capillary has an open inlet at the end of the plug member in abutment with the tobacco column and an open outlet at the opposite end of the plug member;

a generally cylindrical, tubular mouthpiece located in coaxial abutment with the end of the plug member opposite that end in abutment with the tobacco column;

a plurality of grooves formed in the peripheral surface of the mouthpiece extending generally longitudinally of the mouthpiece from one end to the other end, the grooves being generally equally spaced apart about the circumference of the mouthpiece, the open outlet of each capillary communicates with a different one of the grooves; and, air permeable tipping material circumscribing the mouthpiece and plug member, and overlapping a portion of the tobacco column adjacent the plug member whereby smoke from the tobacco column flows through the capillaries in the plug member and into the grooves of the tubular member, and ventilating air flows through the permeable tipping material into the grooves of the tubular mouthpiece wherein the ventilating air and smoke comingle before being discharged from the grooves of the mouthpiece into the smoker's mouth.

13. A cigarette comprising:

a generally cylindrical tobacco column;

a generally cylindrical shaped impermeable plug member located in coaxial abutment with one end of the tobacco column;

a plurality of smoke flow through capillaries formed through the plug member generally longitudinally of the plug member such that each capillary has an open inlet at the end of the plug member in abutment with the tobacco column and an open outlet at the opposite end of the plug member;

a plurality of ventilating air flow grooves formed in the peripheral surface of the plug member extending generally longitudinally of the plug member, each of the grooves being open to at least the end of the plug member having the open capillary outlets;

a generally cylindrical tubular mouthpiece located in coaxial abutting relationship to the end of the plug member at which the air flow grooves are open; and, air permeable tipping material circumscribing the mouthpiece and plug member, and overlapping a portion of the tobacco column adjacent the plug member whereby smoke from the tobacco column flows through the capillaries in the plug member and ventilating air flows through the permeable tipping material into the grooves of the plug member, the smoke from the capillaries and air from the grooves being discharged in separate flow streams into the tubular mouthpiece wherein the smoke and air comingle.

14. The cigarette of claim 13, wherein the wall of the mouthpiece is impermeable.

15. The cigarette of claim 14, wherein:

the ventilation air grooves communicate with the hollow interior of the mouthpiece; and, the smoke flow capillaries communicate with the hollow interior of the mouthpiece.

16. The cigarette of claim 15, wherein the open outlets of the capillaries at the end of the plug member abutting the mouthpiece are displaced from the open ends of the grooves at the same end of the plug member circumferentially of the plug member.

17. The cigarette of claim 15, wherein the open outlets of the capillaries at the end of the plug member abutting the mouthpiece are displaced from the open ends of the grooves at the same end of the plug member circumferentially of the plug member.

18. The cigarette of claim 15, wherein each of open capillary outlets is generally aligned with an open end of a different one of the air flow grooves radially of the plug member.

19. The cigarette of claim 13, wherein:

the open inlets of the capillaries are circumambiently arranged; and, the open outlets of the capillaries are circumambiently arranged.

20. The cigarette of claim 13, wherein the number of grooves is equal to the number of capillaries.

21. The cigarette of claim 13, wherein the tipping material is air permeable over at least a portion of each of the grooves.

22. The cigarette of claim 13, further comprising a porous wrap material circumferentially surrounding the plug member and the mouthpiece beneath the tipping material.

23. The cigarette of claim 13, wherein the plug member further comprises:

a polyethylene plastic peripheral wall; and, a impermeable cellulose acetate core.

24. The cigarette of claim 22, wherein the polyethylene plug wall and cellulose acetate core are formed by coextrusion.

* * * * *